United States Patent [19]

Hahn

[11] Patent Number: 4,939,818

[45] Date of Patent: Jul. 10, 1990

[54] ADJUSTABLE BUNDLING DEVICE

[76] Inventor: Blake S. Hahn, 26331 Governor Ave., Harbor City, Calif. 90710

[21] Appl. No.: 241,010

[22] Filed: Sep. 2, 1988

[51] Int. Cl.[5] ..... B65D 63/00

[52] U.S. Cl. ..... 24/16 R; 24/442

[58] Field of Search ..... 24/306, 16 R, 442; 128/DIG. 15, DIG. 26, 169, 165; 2/DIG. 6; 224/901; 428/100; 604/179, 180

[56] References Cited

U.S. PATENT DOCUMENTS

| | | | |
|---|---|---|---|
| 3,480,012 | 11/1969 | Smithers et al. | 128/DIG. 15 |
| 3,994,048 | 11/1976 | Rosenthal | 24/16 R X |
| 4,088,136 | 5/1978 | Hasslinger et al. | 128/DIG. 26 |
| 4,091,808 | 5/1978 | Nelson | 128/DIG. 15 |
| 4,481,682 | 11/1984 | Hall | 2/DIG. 6 |

*Primary Examiner*—James R. Brittain

*Attorney, Agent, or Firm*—Lyon & Lyon

[57] ABSTRACT

A device for bundling objects such as cable, rope, hose and electrical power supply cords, which includes a flexible strap member with a first end portion, a second end portion, and a center portion with hook and loop fastener material, commonly known under the trademark, VELCRO, which is selectively positioned on sides of the portions. In one embodiment, hook fastener material is placed on one side of the center portion and loop fastener material is placed on one side of the first end portion and on one side of the second end portion, the side of the second end portion having loop fastener material being the opposite to that of the first end portion.

4 Claims, 3 Drawing Sheets

ADJUSTABLE BUNDLING DEVICE

BACKGROUND

1. Field of Invention

This invention relates to bundling devices that assist in convenient storage of lengthy items. These items would include cable, rope, hose, electrical power supply cords, and many other lengthy, flexible items.

2. Description of Prior Art

Many, if not all people experience the need to store a piece of rope, cable, hose, or an electrical power cord. These items are typically stored for a period of time and then taken out of storage and reused. These items are usually coiled and bundled in some fashion to allow for convenient storage.

There are many methods and devices to assist in this regard. The trailing end of the rope, for instance may be wrapped around the bundled coil and tucked in such a way as to bind the coil together. The process is frequently used with cables, hoses, and electrical power supply cords. This is time consuming and unless skilfully done, not very secure. As your own experience would probably demonstrate, the tendency of such bundling is to become loose, unravel and leave the coil in disarray.

Another method would be to use one of many devices to tie the bundle together. A piece of twine will work, but it must be drawn tight and properly tied. Often the knot unravels, leaving the coil a mess, or the knot becomes hard and nearly impossible to untie.

A rubber band may be used, and many heavy grades are available, though never when you need one. Rubber bands are difficult to wrap and tension properly. Rubber bands often rot or oxidize and break in relatively short time. Again the coil is in disarray.

Electricians are familiar with products generally known as wire ties. These devices allow a cinching of bundles of wires, some are reusable, but most are designed for one time use. They have a loop at one end that receives the other end. Their use requires the threading of the loop. This requires two hands for a majority of users. That leaves no hands to hold the coil, and therefore a more difficult assembly. There is also a loose end of the tie protruding from the side of the bundle.

Twist ties of vinyl coated wire have been used for the bundling of these materials, but they typically are not attached to the cable or electric power supply cord. They are easily lost. Twist ties are subject to fatigue and are easily broken upon re-use.

Tape has been used for bundling purposes. The adhesives deteriorate and the tape lets loose. The adhesive leaves sticky residue on the item bundled. Murphy's law dictates that rolls of tape are not available when you need them.

Other bundling devices made with hook and loop fastening material commercially available under the trademark VELCRO exist, but with a metal or plastic ring to assist in tightening the device. The present invention requires no such auxiliary ring, and has the unique construction sequence of materials described below.

Most of us, therefore, would find it desirable to have a device that allows easy, convenient, self adjusting, reusable, and reliable bundling of these items.

OBJECTS AND ADVANTAGES

Accordingly, I claim the following as the objects and advantages of the invention: to provide a device to easily, neatly, and reliably retain a bundle of cable, rope, hose, electric power supply cord, or other length of flexible material, to provide such a device that attaches to the object to be bundled in a secure but adjustable manner, so the device is always available at the moment the bundle is to be secured, to provide a device that is self adjusting, reusable, and transferrable to another item in need of bundle retention.

In addition, I claim the following additional objects and advantages: to provide a device that allows wrapping of the bundle with one hand, while the other hand is used to hold the bundle, to provide a device that requires minimum training or skill to use, to provide such a device that is useable underwater, or in salt air without corrosion.

Readers will find further objects and advantages of the invention from a consideration of the ensuing description and accompanying drawings.

DRAWING FIGURES

Figure 1:
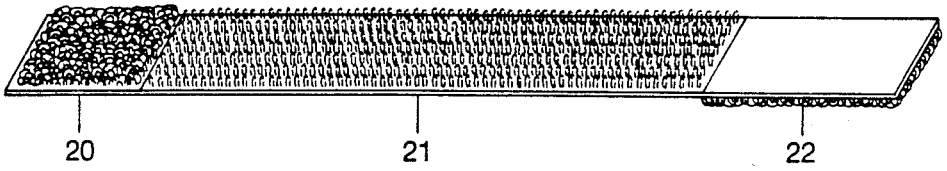
FIG. 1 shows a perspective front elevation view of the device according to the invention hereafter to be known as the type 1 variation.

FIGS. 4A, 4B, 4C, and 4D show views of the device in four stages of use wrapping the electric power supply cord of an electric drill.

FIGS. 5A, 5B, 5C, and 5D show views of the device in four stages of use wrapping a cable, rope, hose, electrical extension cord or other lengthy flexible object.

Drawing Reference Numerals

20. First section of device.
21. Second section of device.
22. Third section of device.
23. Representation of electric drill.
24. Electric power supply cord of electric drill.
25. Device in stages of attachment to power supply cord, or other lengthy flexible object.
26. Representation of cable, rope, hose, electrical extension cord or other lengthy flexible object.

Description of Device

Relative directions are arbitrarily defined to help describe the device. One side of the device is arbitrarily been defined as the top and the other side of the device has arbitrarily been defined as the bottom from the perspective as viewed in the figures. Of course the device can be turned over or oriented in any position.

The device is a simple strap of hook and loop fastening material such as that known under the trademark VELCRO, permanently assembled by glue, stitching, or sonic welding. It may be of various widths and lengths but it has the particular construction described and illustrated hereafter.

VELCRO is a fabric like material which consists of two parts, a "loop" portion which adheres to a "hook" portion. The parts will pull apart with some effort and re-adhere when ever the two different parts are pressed together.

I have constructed a strip of material combining the two VELCRO parts in three sections, 20, 21, and 22. The sections are assembled in the illustrated order, position, and relative length. The overall length and width varies with application. The nature of the VELCRO material on the top and bottom of these sections varies with the type 1, 2, or 3.

The sections are attached to each other with glue, stitching, or a process called sonic welding. In some cases, canvas or nylon strapping will be attached to the backing of the VELCRO materials to add strength to the strap.

The variation types 1, 2, and 3 allow more convenience and personal preference in application. The basic operation is the same for all types. The type 3 strap is completely reversible and is not wrap direction dependent.

FIG. 1 shows the device variation type 1.

The first section, (20) consists of loop part VELCRO begins on the top side of the strap for a short distance. The length of this section varies depending on the overall length of the strap, but this is usually the shortest section.

The second section, (21) consisting of hook part VELCRO, continues on the top side to form the longest section of the strap. The length of this section varies depending on the overall length of the strap, but this is the longest section.

The third section, (22) consisting of loop part VELCRO begins again on the bottom side of the strap. The length of this section varies depending on the overall length of the strap. This section is usually longer than the first section (20) but shorter than the second section (21).

The type 1 strap is not reversible, it must be attached to the item to be bundled with the top of the first section (20) against the top of the second section (21) and must be wrapped with hook of the second section (21) facing out.

Figure 2:
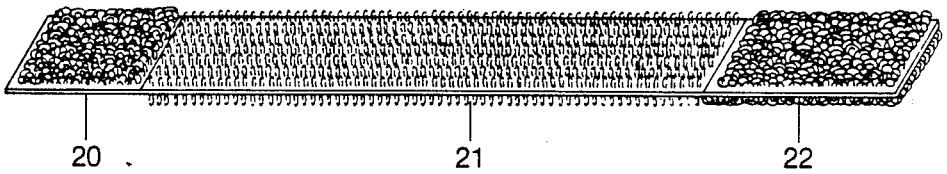
FIG. 2 shows a perspective front elevation view of the device according to the invention hereafter to be known as the type 2 variation.

FIG. 2 shows the device variation type 2.

The first section (20), consists of loop part VELCRO that begins on the top side of the strap for a short distance. The length of this section varies depending on the overall length of the strap, but this is usually the shortest section.

The second section (21), hook part VELCRO continues on both sides to form the longest section of the strap. The length of this section varies depending on the overall length of the strap, but this is the longest section.

The third Section (22), loop part VELCRO begins again on both sides of the strap. The length of this section varies depending on the overall length of the strap. This section is usually longer than the first section (20) but shorter than the second section (22).

The type 2 strap first section (20) is not reversible but the rest of the device is reversible, and is not wrap direction dependent.

Figure 3:
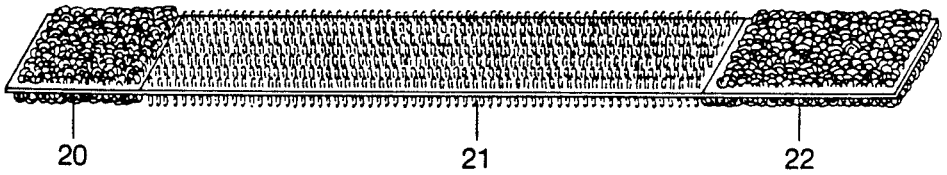
FIG. 3 shows a perspective front elevation view of the device according to the invention hereafter to be known as the type 3 variation.

FIG. 3 shows the device variation type 3.

The first section (20), consists of loop part VELCRO begins on both sides of the strap for a short distance. The length of this section varies depending on the overall length of the strap, but this usually is the shortest section.

The second section (21) hook part VELCRO continues on both sides to form the longest section of the strap. The length of this section varies depending on the overall length of the strap, but this is the longest section.

The third section (22) loop part VELCRO begins again on both sides of the strap. The length of this section varies depending on the overall length of the strap. This section is usually longer than the first section (20), but shorter than the second section (21).

Device Operation

The sequence of operation of the invention is shown in four steps in FIG. 4.

Figure 4A:
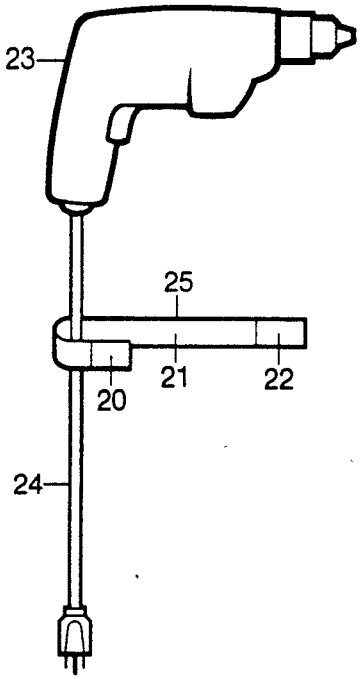

In FIG. 4A the device is attached to the electric drill power supply cord by placing the cord over the device at the intersection of the first and second sections. The first section (20) is then wrapped over the cord and pressed into the second section (21) to form a snug loop around the cord. Type 1 and 2 devices must have the top surface loop section (20) facing the cord. Type 3 is completely reversible.

Figure 4B:
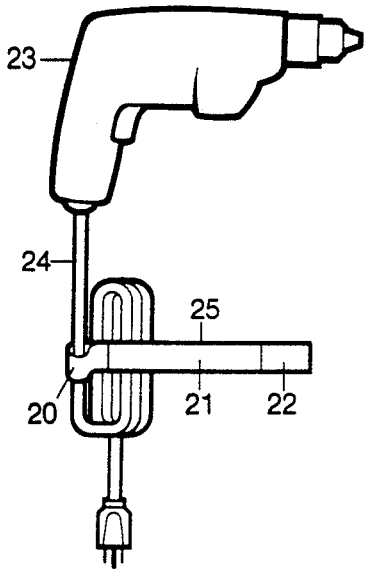

FIG. 4B illustrates the drill and power supply cord after it is coiled with the invention in position to be wrapped.

Figure 4C:
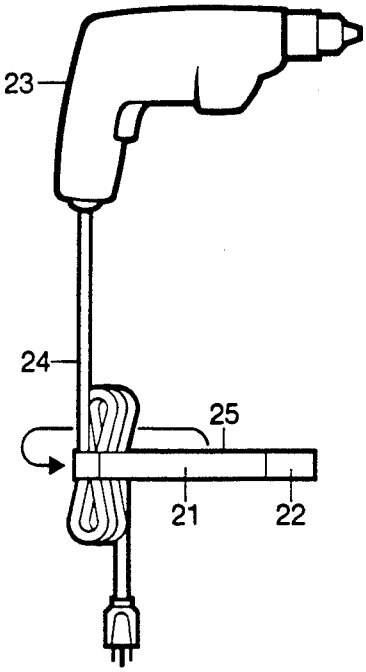

FIG. 4C indicates the direction of wrap for the type 1 device. The bundling process is the same for type 2 and 3 but the direction of wrap becomes optional because of their reversible nature.

Figure 4D:
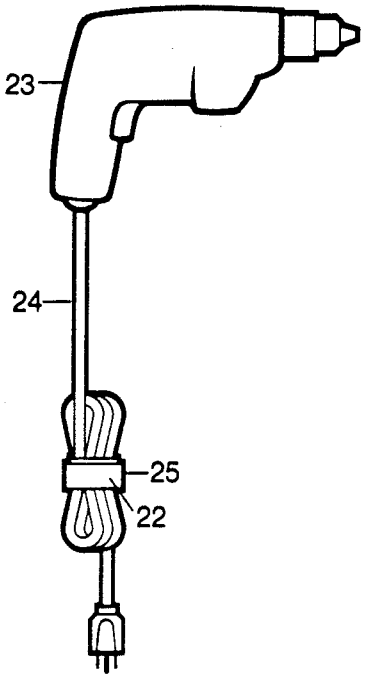
Figure 5A:
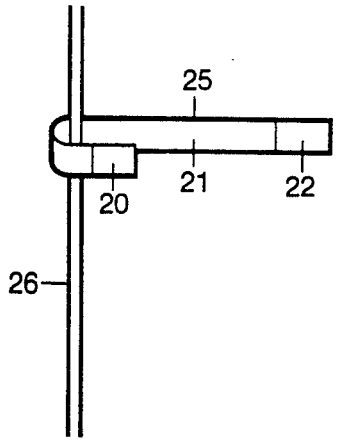
Figure 5B:
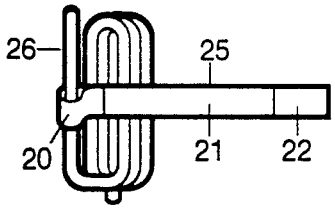
Figure 5C:
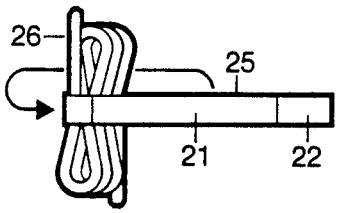
Figure 5D:
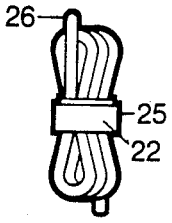

FIG. 4D shows the wrap repeating and progressing to completion. FIG. 4D illustrates the third section (22) loop attached to the second section (21) hook with the wrap completed and the bundle secured.

FIG. 5 illustrates the process on a representation of cable, rope, hose, electrical extension cord or other lengthy flexible item in four steps progressing A through D. The process is similar to the electric drill power supply cord example FIG. 4.

CONCLUSION

The prior descriptions of this invention will indicate to the reader the considerable utility and versatility of the device.

Thus I have described a bundling device for wrapping around and thereby attaching to and securing the objects to be bundled, comprised of a single, independent strap, using no cinching rings, constructed in part or whole of materials designed to be self attaching, assembled in such a way as to allow both end sections of the bundling device to be attached to more central sections of the bundling device.

While my above description contains many specificities, these should not be construed as limitations on the scope of the invention, but rather as an exemplification of one preferred embodiment thereof.

Many variations are possible, for example, dimensions may be increased and the backing reinforced to provide for securing large or heavy bundles. The device may be attached to a fixed object and used to secure items to it.

Accordingly, the scope of the invention should be determined not by the embodiment(s) illustrated, but by the appended claims and their legal equivalents.

I claim:

1. A device for bundling objects, comprising a flexible strap member having a first end portion, a second end portion, and a center portion, the flexible strap member having a top side and a bottom side;

hook and loop type fastener sections on portions of the flexible strap member comprising a first loop fastener section on the top side of the first end portion, a second loop fastener section on the bottom side of the second end portion, and a first hook fastener section on the top side of the center portion, wherein the hook and loop type fastener sections further comprise a third loop fastener section on the top of the second end portion and a second hook fastener section on the bottom of the center portion.

2. The device of claim 1 wherein the hook and loop type fasteners sections further comprise a fourth loop type fastener section on the bottom of the first end portion.

3. A fastening device comprising a flexible strap member having a first end portion, a second end portion, and a center portion wherein the first end portion has loop type fastener material on both sides thereof along its entire length, the second end portion has loop type fastener material on both sides thereof along its entire length, and the center portion has hook type fastener material on both sides thereof along its entire length.

4. The device of claim 3 wherein the center portion is longer than the first end portion and the second end portion.

* * * * *